US005123345A

United States Patent [19]

Wood

[11] Patent Number: 5,123,345

[45] Date of Patent: Jun. 23, 1992

[54] MULTI-PURPOSE DECORATING MACHINE

[76] Inventor: Gary E. Wood, 318 Linklea, Duncanville, Tex. 75137

[21] Appl. No.: 557,479

[22] Filed: Jul. 25, 1990

[51] Int. Cl.[5] ..... B41F 15/14; B41F 17/00

[52] U.S. Cl. ..... 101/124; 101/38.1; 101/163; 101/DIG. 49

[58] Field of Search ..... 101/123, 124, 126, 163, 101/38.1, DIG. 49

[56] References Cited

U.S. PATENT DOCUMENTS

| | | | |
|---|---|---|---|
| 3,251,298 | 5/1966 | Rudolph et al. | 101/123 X |
| 4,060,031 | 11/1977 | Philipp | 101/163 |
| 4,404,903 | 9/1983 | Cronin | 101/123 |
| 4,593,616 | 6/1986 | Lorenzi | 101/163 |

*Primary Examiner*—Clifford D. Crowder
*Attorney, Agent, or Firm*—Hubbard, Thurman, Tucker & Harris

[57] ABSTRACT

The squeegee arm and screen frame portions of a tilt screen type screen printing machine are pivotally connected to specially designed rocker housings slidably movable along horizontal support rods. The rocker housings have portions which are not rotated by pivoting of the squeegee arm and screen frame, thus permitting such rocker housing portions to be horizontally driven along the support rods by rodless air cylinders mounted on the machine. Additionally, the nonrotatable portion of the screen frame rocker housing carries a horizontally disposed gear rack which can be operatively mated with a pinion drive gear portion of a rotatable fixture supporting a round item to be printed so that horizontal translation of the rack rotationally drives the fixture during the screen printing process. Because of the rocker housing design, upward tilting and horizontal movement of the screen frame does not disrupt the rack and pinion registry. The machine is provided with a variety of special attachments which permit it to carry out a two-color hat printing process and a pad printing process in addition to single-color flat and round article screen printing processes. Additionally disclosed is the conversion of a conventional screen printing machine to a pad transfer printer.

23 Claims, 7 Drawing Sheets

MULTI-PURPOSE DECORATING MACHINE

BACKGROUND OF THE INVENTION

The present invention relates generally to the imprintation of decorative or informative indicia on articles, and more particularly relates to tilt screen type screen printing machines used for such imprintation purposes.

Tilt screen type screen printing machines are well known devices and are commonly used to print decorative and informative indicia on a wide variety of both flat and round articles such as paper stock, tee shirts, cans, bottles, cups and the like. Conventional screen printing machines typically comprise a base frame structure upon which a vertically spaced pair of horizontal upper and lower support rods are carried. The upper and lower rods are respectively utilized to support a squeegee carrying structure and a printing screen support frame structure, each of which is translatable along the length of its associated support rod and is pivotable about the rod axis.

The squeegee carrying and printing screen support frame structures of these conventional machines are typically anchored to carrier members which are slidably and rotatably mounted on the support rods. This connection method permits the desired horizontal translation and vertical pivoting of both the squeegee carrying structure and the printing screen support frame structure. When either structure is vertically pivoted its carrier member, in its entirety, is also pivoted about its associated support rod.

To use the machine, a printing screen is suitably clamped to the screen support frame structure and both the squeegee carrying structure and the screen are upwardly pivoted. The article to be imprinted is supported on a lift table structure beneath the screen and squeegee, and the screen and squeegee are lowered to their operative positions directly above the article. A relative horizontal movement is then created between the screen and squeegee to cause the squeegee to drive ink (previously deposited on the upper side of the screen) downwardly through the screen and onto the supported article to imprint thereon predetermined indicia formed on the screen. The screen and squeegee are then pivoted upwardly away from the now imprinted article, the imprinted article is removed from the lift table and replaced with another article, and the imprintation process is repeated.

In the case of flat articles, such as paper stock or tee shirts, the lowered printing screen is held stationary while the squeegee is horizontally moved across the upper side surface of the screen. When round articles such as bottles or cans are being imprinted, the squeegee is held stationary while the screen is horizontally translated and the article is simultaneously rotated.

As is well known in the printing art, conventional tilt screen type printing machines of this general type are subject to a variety of problems, limitations and disadvantages. For example, when round articles are being imprinted it is often necessary to maintain a precise correlation between the horizontal motion of the screen and the rotation of the article to assure a correct circumferential positioning of the imprintation on the round article being decorated. For example, when cups are being imprinted it is of course desirable that the resulting imprinted indicia on every cup is positionally related to its handle in the same manner.

For each successive cup this requires that, at the beginning of the horizontal screen stroke, the cup handle be rotationally oriented at a starting position identical to the starting position of every other cup to be imprinted with the same screen indicia. In the past, this necessary screen/article motion correlation has essentially prevented the effective use of a tilt screen type screen printing machine to imprint round articles.

Another problem heretofore associated with conventional tilt screen printing machines has been the difficulty in using power drive mechanisms to horizontally translate the squeegee support and printing screen support frame structures back and forth along their support rods. This problem arises due to the fact that as the squeegee support and printing screen support frame structures are pivoted their carriers are also pivoted about their associated support rods. This resultant pivoting of the carrier members has heretofore required the use of a fairly complex and expensive translational drive system to compensate for such pivoting.

A further limitation of conventional screen printing machines of this type is that they are typically only capable of performing screen printing processes. In order to carry out other imprintation tasks such as, for example, pad transfer printing, it has heretofore been necessary to use a separate machine or system. Additionally, from a somewhat broader perspective, conventional tilt screen type screen printing machines have tended to be relatively large, complex and expensive.

In view of the foregoing, it is accordingly an object of the present invention to provide an improved tilt screen type screen printing machine which eliminates or minimizes the above-mentioned and other problems, limitations and disadvantages heretofore associated with conventional screen printing machines of the general type described.

SUMMARY OF THE INVENTION

Various aspects of the present invention, by themselves and in combinations with one another, may be utilized to provide substantial structural and operational improvements in a tilt screen type screen printing machine of the general type described above. Set forth below are brief summaries of various features of the present invention. The sole purpose of the following summarization is to provide a general overview of the present invention, and is not to be construed as in any manner limiting its nature or scope.

According to one aspect of the present invention, the upper and lower carrier structures mounted on the elongated horizontal support rods of a tilt screen type screen printing machine, and operatively secured to the machine's squeegee carrying and printing screen support frame structures, respectively, are each formed in two sections. The first section is axially translatable along the length of its associated support rod, and the second section is carried by the first section for rotation relative thereto about an axis parallel to the rod axis. Means are provided for preventing appreciable rotation of the first section.

This unique construction of the carrier structures permits them to be translationally driven in a simple and inexpensive fashion by conventional rodless air cylinder drive structures horizontally supported on the machine frame, with the axially drivable outer portions of the drive structures being secured to the nonrotatable first sections of the upper and lower carrier structures.

In one embodiment of the present invention, a round article to be imprinted is rotatably supported on an article support structure rotationally drivable via a pinion gear operatively mounted thereon. The pinion gear meshes with and is rotationally drivable by an elongated gear rack member anchored to the nonrotatable first section of the lower carrier structure for translation therewith. Because of the special two section construction of the lower carrier structure, upward pivoting and horizontal translation of the printing screen support frame structure does not disengage the gear rack member from the pinion gear. Accordingly, a precise correlation between the translational position of the printing screen support frame structure and the rotational orientation of the article to be imprinted may be maintained at all times, thereby facilitating the use of a tilt screen type screen printing machine in imprinting round articles.

According to another feature of the present invention, specially designed attachments are used to convert the machine to an easily and rapidly usable two color round object screen printing machine. These attachments include a dual squeegee support structure secured to the second section of the upper carrier structure, and a specially designed rotatable article support structure which is rotationally drivable by a pinion gear engaged by the previously mentioned gear rack. The article support structure has a rotatable head portion to which the article may be secured, the head portion being axially movable toward and away from the pinion gear between axially extended and axially retracted positions.

Two printing screens are secured to the printing screen support frame structure, one of the printing screens having a first color printing ink thereon, and the other screen having a second color printing ink thereon. With the support frame structure in its lowered position, the article support structure head portion in its extended position is directly beneath the first screen, and movement of the head portion to its retracted position places the head portion, and the article which it rotatably carries, directly beneath the second screen.

The dual squeegee support structure carries first and second squeegee members which, with the squeegee support structure downwardly pivoted, may be respectively positioned over the first and second screens, each of the squeegee members being selectively and independently lowerable onto the top side surface of its associated screen.

To use the machine in its two color printing mode, the article support structure head portion is moved to its extended position, the squeegee support structure and the screens are moved to their downwardly pivoted operating positions, the first squeegee member is lowered onto the first screen, and the screens are translated relative to the stationary fist squeegee member to imprint the rotating article with the first color indicia. Next, the screens and the squeegees are pivoted upwardly, the screens are moved back to their translational starting position, and the rotatable head portion is moved to its retracted position. The frames and the squeegee structure are then downwardly pivoted, the second squeegee member is lowered onto the second screen, and the screens are horizontally translated to imprint the second color indicia on the rotating article.

According to another aspect of the present invention, special attachments are secured to the machine to convert it to a pad transfer printer. These attachments include: a first lever transversely secured at its inner end to the second section of the second carrier structure and having cliche scraper blade secured to an outer end portion thereof; a second lever transversely secured at its inner end to the second section of the first carrier structure and having a flexible pad printing member secured to its outer end; and a lift table structure operative to support, in a side-by-side orientation, a horizontal cliche plate with recessed indicia on its upper side surface and an article to be pad printed.

To imprint the article, a quantity of printing ink is deposited on the upper side of the cliche plate, the first lever is downwardly pivoted to bring the scraper blade into engagement with the cliche plate, and the first lever is translated back and forth to position the ink within the recessed indicia and remove the remaining ink from the top surface of the plate.

The second lever is then downwardly pivoted to compress the pad printing member against the indicia to operatively transfer ink to the underside of the compressed member. The second lever is then upwardly pivoted, translated away from the cliche plate toward the article, and downwardly pivoted to compress the pad printing member against the article and transfer the ink design thereto.

According to a still further feature of the present invention a conventional, non-tilt screen type screen printing machine is inexpensively converted to a pad transfer printer by operatively securing a cliche scraper blade and a pad transfer member to the non-pivotable screen support frame portion of the machine in a manner permitting the normal motions of the base and screen frame portions of the machine to effect a pad transfer printing process.

DETAILED DESCRIPTION

Figures 1, 3:
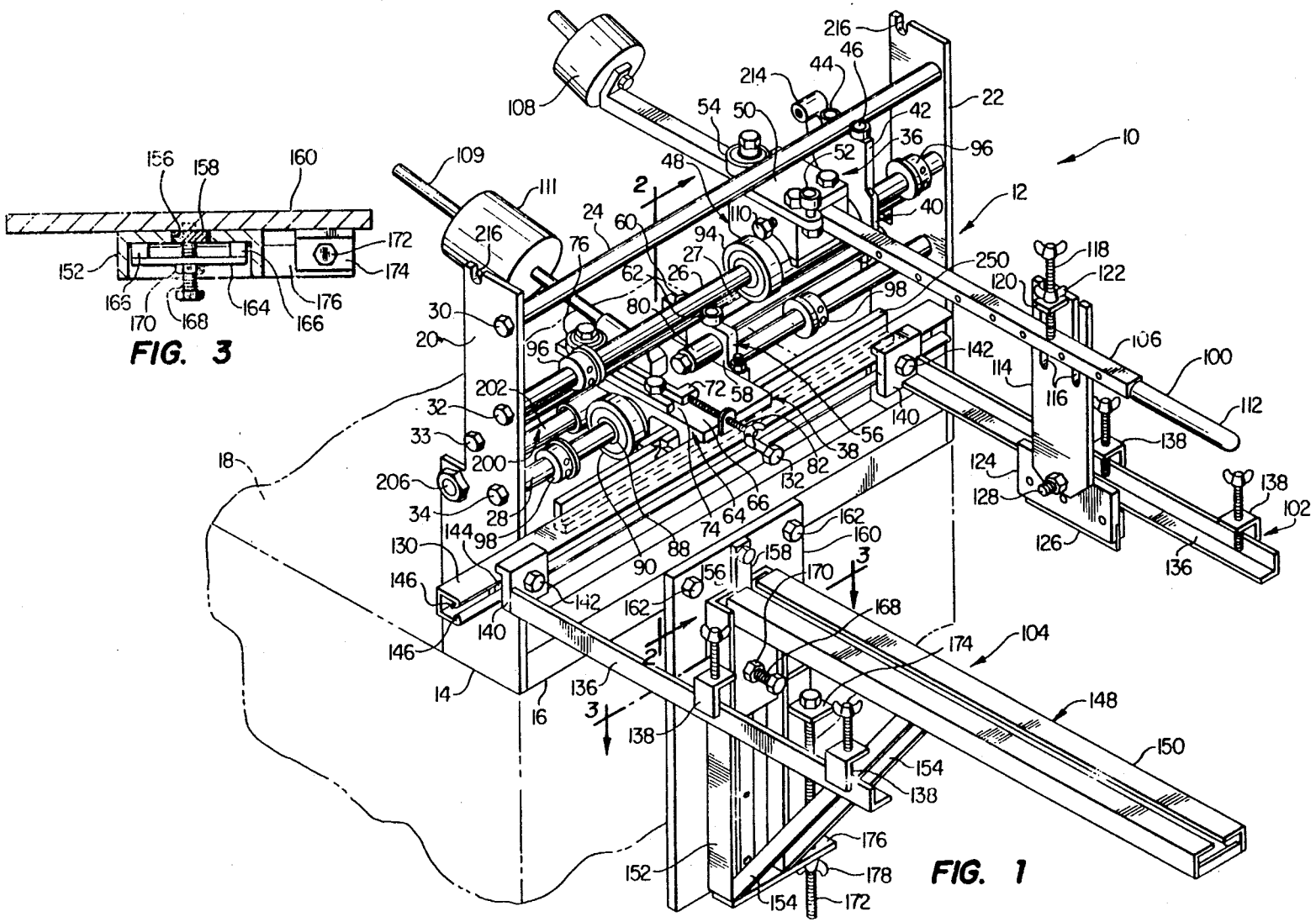
FIG. 1 is a perspective view of an improved, tilt screen type screen printing machine embodying principles of the present invention.
FIG. 3 is an enlarged scale cross-sectional view through a lift table portion of the machine taken along line 3—3 of FIG. 1.

Referring initially to FIG. 1, the present invention provides a multi-purpose decorating apparatus 10 which includes an improved, tilt screen type screen printing machine 12. Machine 12 comprises a generally U-shaped support frame structure 14 having an elongated base portion 16 suitably anchored to the top of a support structure, such as the table 18 illustrated in phantom, and a pair of elongated support plate members 20 and 22 extending upwardly from the opposite ends of the base portion 16. Extending horizontally between the support plate members 20 and 22 are, from top to bottom in FIG. 1, metal rods 24, 26, 27 and 28 which are secured at their opposite ends to the vertical support plate members 20, 22 by bolts 30, 32, 33 and 34.

Figure 2A:
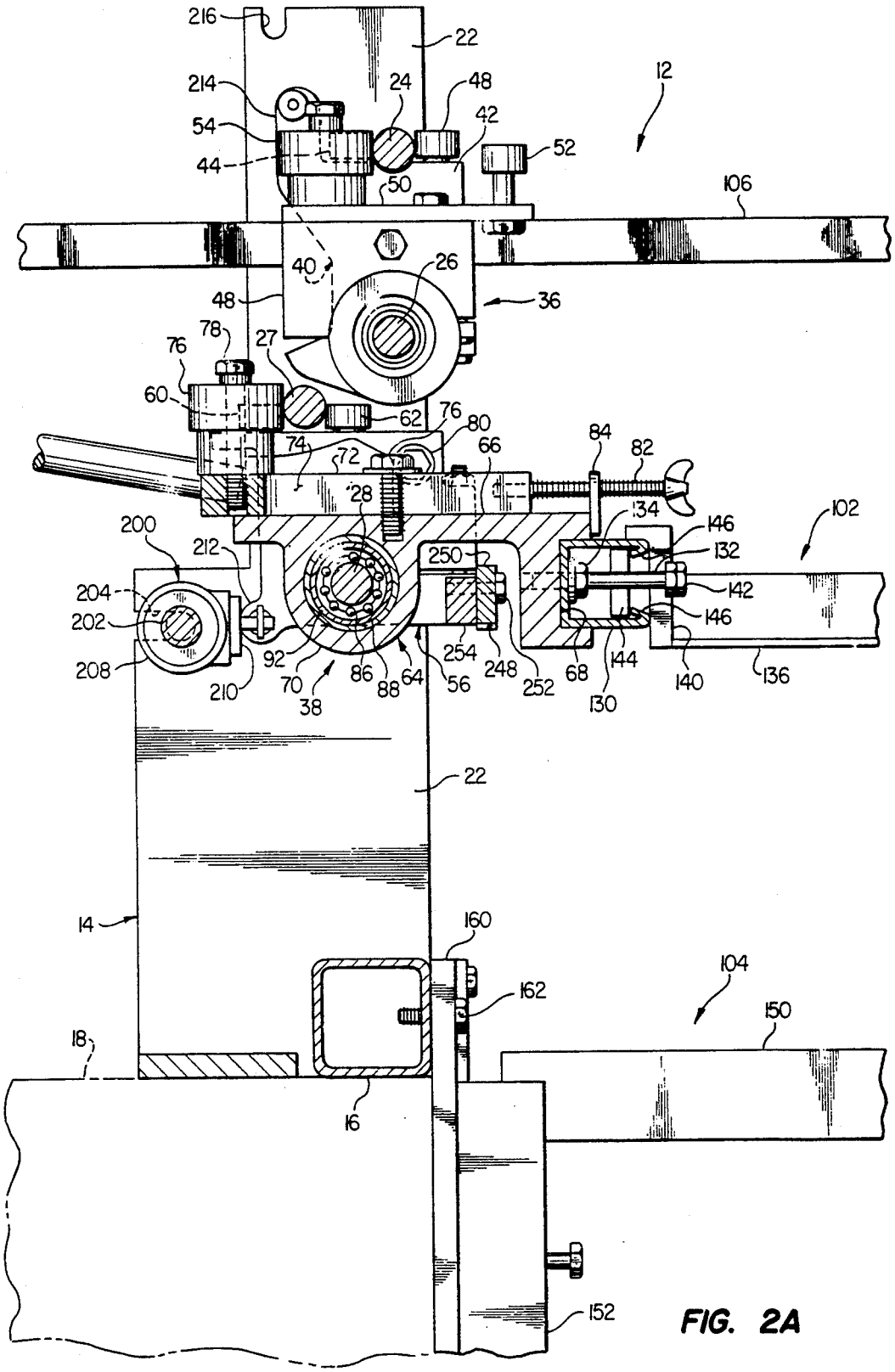
FIGS. 2A and 2B are enlarged scale cross-sectional views through the machine taken along line 2—2 of FIG. 1 and illustrating the operation of specially designed rocker housing portions of the machine.
Figure 2B:
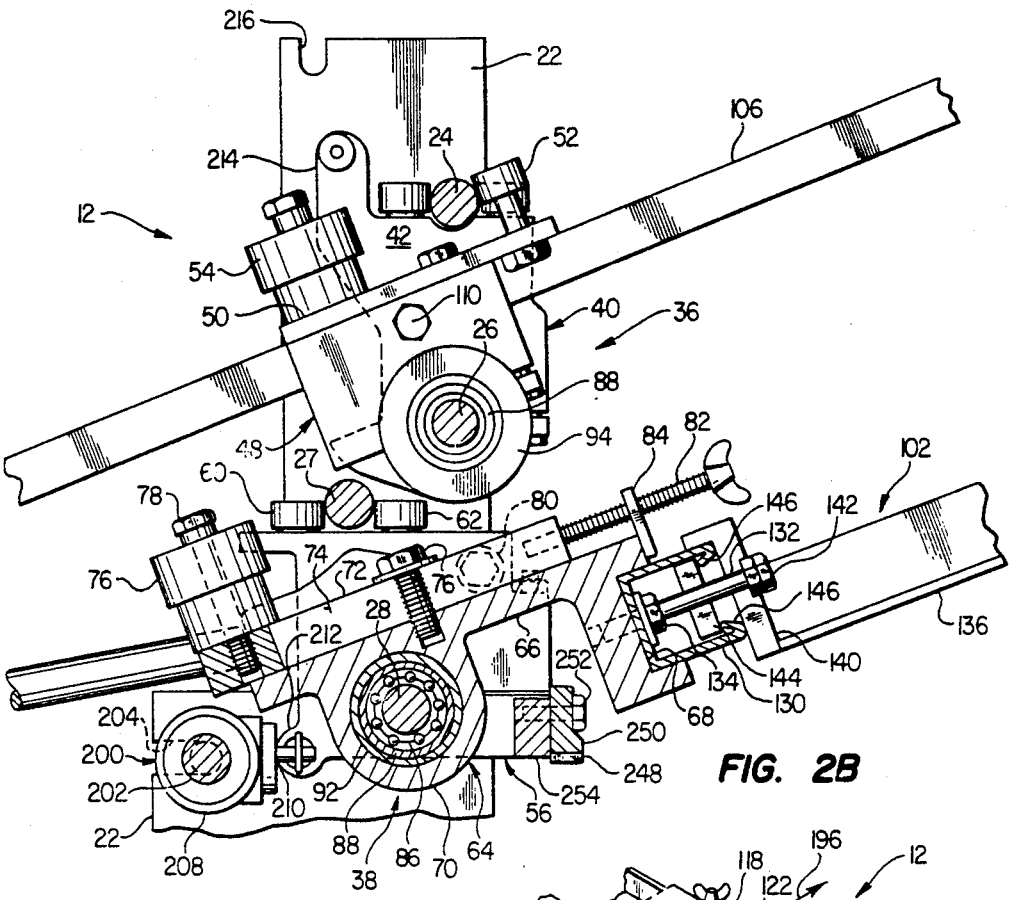

According to a feature of the present invention, the rods 26 and 28, respectively, have mounted thereon specially designed rocker housing structures 36 and 38 which provide the screen printing machine 12 with a variety of advantages subsequently described herein. Referring now to FIGS. 1, 2A and 2B, the upper rocker housing 36 has a first portion 40 which circumscribes and is horizontally translatable along the rod 26 and includes an upwardly projecting right end plate 42 provided at its upper end with stop rollers 44 and 46 which rollingly engage opposite sides of the upper rod 24 and prevent the rocker housing portion 40 from rotating about rod 26.

In a manner subsequently described, a hollow second portion 48 of the rocker housing structure 36 is carried by the first portion 40 for horizontal translation therewith along the rod 26, and rotation relative to the first portion 40 about the axis of rod 26. The upper end of the second rocker housing portion 48 has a cover plate member 50 secured thereto. Front and rear stop rollers 52 and 54 secured to the plate 50 are positioned on opposite sides of the upper rod 24 and may be brought into rolling engagement therewith to limit the pivotal motion of the rocker housing portion 48 relative to the nonrotatable rocker housing portion 40 as may be seen by comparing FIGS. 2A and 2B.

In a similar fashion, the lower rocker housing structure 38 has a first portion 56 which circumscribes and is translatable along the length of the support rod 28. At its right end, the rocker housing portion 56 includes an upturned plate 58 provided at its upper end with stop rollers 60 and 62 which rollingly engage opposite sides of the rod 27 and prevent rotation of the rocker housing portion 56 about the axis of rod 28.

A second portion 64 of the lower rocker housing structure 38 is carried by its first portion 56 for rotation relative thereto about the axis of rod 28, and includes an elongated bracket number 66 which outwardly circumscribes the rod 28 and has a front end with a horizontally extending channel 68 formed therein, and a rear end portion 70 which outwardly circumscribes the rod 28.

Slidably positioned atop the upper side of the bracket member 66 is an adjustment member 72 having a slot 74 extending along its length. The adjustment member 72 is frictionally secured to the top side of the bracket member 66 by means of a bolt 76 extended downwardly through the slot 74 and threaded into the bracket 66. By loosening and then retightening the bolt 76, the front-to-rear position of the adjustment member 72 relative to the bracket 66 may be selectively adjusted. A stop roller 76 is secured to the left or rear end of the adjustment member 72 by means of a bolt 78. Stop roller 76, when it is brought into engagement with the rod 27 as shown in FIG. 2A, serves to limit the clockwise pivotal motion of the lower rocker housing portion 64. A stop member 80 projecting leftwardly from the upturned plate 58, when engaged by the upper side surface of the bracket member 66 as illustrated in FIG. 2B, serves to limit the counterclockwise pivotal motion of the lower rocker housing portion 64. Front-to-rear adjustment of the adjustment member 72, using the bolt 76 and a bolt 82 threaded into the front end of member 72 and passing through an upturned flange 84 on the front end of bracket member 66, permits for selective variations in the total amount of clockwise pivotal motion of the rocker housing portion 64.

With continued reference to FIGS. 1, 2A and 2B, the lower rocker housing structure 38 includes an annular slide bearing 86 which circumscribes the rod 28 and is fixed within an elongated metal tube 88. The opposite ends of the tube 88 project outwardly beyond the rear end portion 70 of the bracket member 66. The outwardly projecting left end of tube 88 has a locking collar 90 clamped thereon, and the upturned plate 58 is fixedly secured to the outwardly projecting right end of tube 88.

The metal tube 88 is coaxially positioned within, and rotatably engaged by rotational bearing means in the form of a cylindrical brass bushing 92 which circumscribes the tube and is carried within the rear end portion 70 of the bracket member 66. Accordingly, the slide bearing 86 facilitates horizontal translational movement of the rocker housing structure 38 along rod 28, while the interaction between the brass bushing 92 and the metal tube 88 facilitates rotation of the bracket housing portion 64 relative to the nonrotatable bracket housing portion 56. An identical slide bearing, metal tube and brass bushing structure is disposed within the upper rocker housing structure 36, with a locking collar 94 being clamped to the outwardly projecting left end of the tube in the upper rocker housing structure 36, and the plate member 42 being fixedly secured to the outwardly projecting right end of the upper tube. The range of horizontal movement of the upper rocker housing structure 36 along rod 26 may be selectively limited by means of a pair of lockable stop collar members 96 which circumscribe the rod 26 on opposite ends of the upper rocker housing structure and may be releasably locked to the rod 26 at selectively variable axial positions thereon. In a similar fashion, stop collar members 98 are releasably locked to the rod 28 and may be axially adjusted thereon to act as stops to thereby selectively vary the maximum horizontal stroke of the lower rocker housing structure 38.

The screen printing machine 12 also includes a squeegee support structure 100, a printing screen support frame structure 102, and a lift table assembly 104. The squeegee support structure 100 includes an elongated squeegee pivot lever 106, a rear end portion of which slidably extends through the second portion 48 of the upper rocker housing structure 36, with the left or rear end of the lever 106 having a counterweight 108 suitably secured thereto. To similarly bias the rotatable portion 64 of the lower rocker housing structure 38, an elongated rod 109, with an adjustable counterweight 111 thereon, is secured to the rotatable portion 64.

Lever 106 may be longitudinally adjusted in a front-to-rear direction relative to the upper rocker housing structure 36 by means of a set screw 110 which extends through the rocker housing portion 48 and bears against the side of the lever portion positioned therein. The right end of lever 106 is provided with a handle portion 112 which may be pulled downwardly to pivot the lever 106 and the upper rocker housing portion 48 in a clockwise direction to bring the lever 106 to its generally horizontal operating position (FIG. 2A), or pushed upwardly to pivot the lever 106 and the upper rocker housing portion 40 in a counterclockwise direction (FIG. 2B).

A vertically elongated support plate 114 is secured to lever 106, adjacent handle portion 112, by means of a pair of slots 116 formed in the upper end of plate 114 and receiving retaining members (not visible) projecting laterally outwardly from the lever 106. Vertical adjustment of plate 114 may be effected by means of an adjustment bolt 118 extending downwardly through a threaded opening in a tab 120 and bearing at its lower end against the upper side of the lever 106. By turning the bolt 118 in a clockwise direction (as viewed from the top in FIG. 1), the plate 114 may be raised relative to the lever 106. In a similar fashion, by turning the bolt 118 in a counterclockwise direction the plate 114 is lowered. Plate 114 may be locked in its selectively variable vertically adjusted position by means of a wing nut 122 threaded onto the bolt 118 and bearing against the upper side surface of the tab 120. At the lower end of the plate 114 a transverse plate 124, which carries a downwardly projecting flexible squeegee member 126, is pivotally secured by a bolt 128.

As illustrated in FIGS. 1 and 2A the printing screen support frame structure 102 includes a horizontally disposed support channel member 130 having, along its length, a generally U-shaped cross section. A central longitudinal portion of the support member 130 is received within the channel 68 at the front end bracket member 66, and is retained therein by means of a bolt 132 provided with a lock nut 134. Projecting forwardly or rightwardly from opposite end portions of the support channel member 130 are elongated screen support members 136 having screen edge clamp structures 138 secured to outer end portions thereof. In a conventional manner (not illustrated) the positions of the clamps along the lengths of the screen support members may be selectively adjusted.

The inner ends of the screen support members 136 are secured to mounting brackets 140 which are anchored to support member 130 by means of screws 142 extending through the brackets 140 and screwed into retaining plates 144 disposed within the support channel member 130 and bearing outwardly against inturned lip portions 146 thereof. This connection of the inner ends of the screen support members 136 to the support channel 130 permits the positional adjustment of the members 130 toward and away from each other along the length of channel 130 simply by loosening the screws 142, horizontally adjusting the positions of the members 136, and then retightening the screws 142. As illustrated in FIGS. 2A and 2B, the entire printing screen support frame structure 102 is pivotable upwardly and downwardly with the portion 64 of the lower rocker housing structure 38.

Referring now to FIGS. 1 and 3, the lift table assembly 104 includes a generally L-shaped support structure 148 having horizontal and vertical arm portions 150, 152 diagonally cross-braced to one another by bars 154. Vertical arm portion 152 has, along its vertical length, a generally U-shaped cross-section, and has a slot 156 extended downwardly through its back side. Slot 156 slidably receives a vertical bar 158 extended downwardly along the front side of a vertically elongated plate 160 secured at its upper end to the frame base portion 16 by bolts 162. The inner end of the horizontal arm portion 150 has a downturned flange 164 which is spaced forwardly apart from and anchored at points 166 to the inner side of the vertical arm portion 152.

The table support structure 148 may be vertically adjusted relative to the plate 160 by means of a bolt 168 which extends inwardly through a threaded opening in the downturned flange 164 and bears against the vertical bar 158 to frictionally hold the table support structure 148 in its vertically adjusted position. As illustrated, the bolt 168 has a suitable lock nut 170 thereon which bears against the outer side surface of the flange 164. To further support the structure 148 in its vertically adjusted position, an elongated bolt 172 is extended downwardly through an opening in a tab 174 projecting outwardly from the plate 160 and downwardly through an opening in a plate 176 at the bottom of the vertical arm portion 152, the lower end of the bolt 172 having a wing nut 178 thereon.

Figure 4:
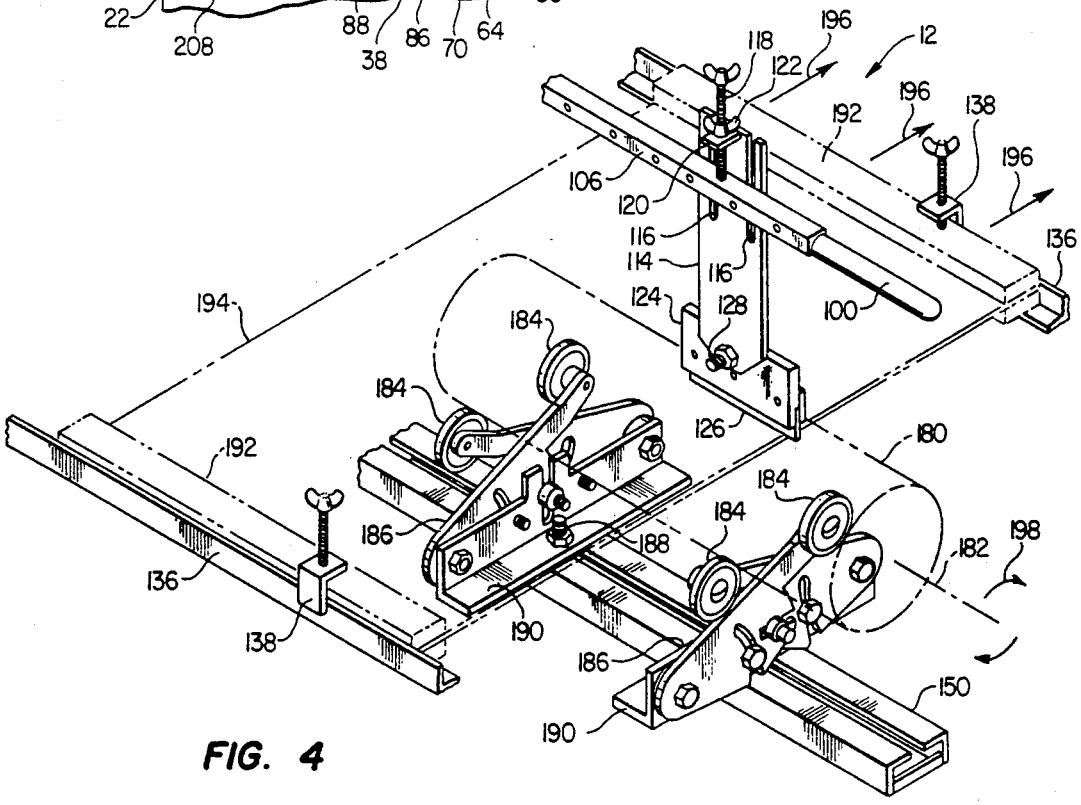
FIG. 4 is a fragmentary perspective view of the machine being used to transfer a design from a supported printing screen to the exterior side surface of a rotationally supported, schematically depicted bottle shown in phantom.

In FIG. 4 the screen printing machine 12 is illustrated carrying out a screen printing process on a round object such as the schematically depicted bottle 180. Bottle 180 is supported, for rotation about its longitudinal axis 182, on the roller portions 184 of a pair of height adjustable, scissors-type support assemblies 186 secured to the horizontal arm portion 150 of the lift table assembly 104 by means of bolts 188 securing angled base portions 190 of the support assemblies 186 to the horizontal lift table arm portion 150. Opposite edge portions 192 of a printing screen 194 are secured to the screen support members 136, using the screen clamps 138, to position the screen just above the upper side surface of the bottle 180.

In the usual manner, a supply of printing ink (not shown) has been appropriately deposited on the upper side of screen 194 over indicia thereon to be screen printed upon the outer side surface of the bottle 180. The total left-to-right "stroke" of the printing screen support frame structure 102 has been set by longitudinally adjusting the stop collar members 96 (FIG. 1) which form left and right horizontal travel stops for the upper rocker housing structure 36 as previously described.

With the illustrated screen 194 pivoted down to its generally horizontal operating position over the bottle 180, and the screen being at the left end of its overall horizontal stroke, the pivot lever 106 is pivoted downwardly to bring the squeegee 126 into engagement with a portion of the screen 194 and press such screen portion downwardly into engagement with the upper side of the rotatably supported bottle 180. The printing screen support frame structure 102 is then moved rightwardly as indicated by the arrows 196 in FIG. 4. Such rightward movement of the screen 194 frictionally rotates the bottle 180 in a clockwise direction as indicated by the arrow 198, while at the same time causing the stationary squeegee member 126 to force printing ink downwardly through the rightwardly moving screen onto the rotating bottle side surface to imprint the desired screen indicia thereon.

After the screen 194 has been moved to the rightward limit of its preset horizontal stroke, the squeegee pivot lever 106 and the screen 194 are pivoted upwardly away from the now imprinted bottle 180 which is then removed from the support assemblies 186. Another bottle is then operatively positioned on the support assemblies 186, and the upwardly pivoted screen 194 is moved to the leftward limit of its preset horizontal stroke. Screen 194 is then pivoted downwardly to its horizontal operating position, and the squeegee pivot lever 106 is also downwardly pivoted to its operative position to ready the new bottle for imprinting thereof.

It will be appreciated by those skilled in this art that a conventional flat item, such as a sheet of paper stock, a tee shirt or the like, may also be screen printed using the machine 10. In such flat printing process, the flat item to be imprinted is horizontally supported on the upper side of the horizontal arm portion 150 using a conventional flat support structure. In the flat printing process, however, the screen 194 is locked against left-to-right horizontal movement, using the stop collar members 98 (FIG. 1), squeegee member 126 is horizontally moved across the upper surface of the horizontally stationary screen 194 to transfer screen indicia onto the flat item positioned below the screen, the horizontal stroke limits of the squeegee member 126 being preset using the stop collar members 96.

The horizontal translation of the squeegee structure 100 and the printing screen support frame structure 102 may be effected manually. However, they may also be automatically driven between their horizontal limit positions, in a substantially improved and simplified manner compared to conventional screen printing machines of this general type, due to the unique configuration and operation of the upper and lower rocker housing structures 36 and 38 previously described. For example, with reference now to FIGS. 1, 2A and 2B, the printing screen support frame structure 102 may be horizontally translated using a conventional rodless air drive cylinder structure 200 powered by a suitable supply source of pressurized air (not shown). The cylinder structure 200 includes an elongated inner cylinder member 202 whose opposite ends are received in notches 204 formed in rear edge portions of the support plate members 22 and retained in such notches by bolts 206. In response to the introduction of pressurized air into the inner cylinder member 202, a shorter outer cylinder member 208 mounted externally thereon may be selectively driven rightwardly or leftwardly along the length of the inner cylinder member 202.

The outer cylinder member 208 is secured, by suitable attachment structure 210, to a connection tab 212 projecting rearwardly from the nonrotatable portion 56 of the lower rocker housing structure 38. Accordingly, when the outer cylinder portion 208 is driven along the length of the inner cylinder portion 202, the entire lower rocker housing structure 38, together with the screen support frame structure 102 which it carries, is correspondingly driven along the length of the support rod 28.

Quite importantly, because the rocker housing portion 56 does not pivot with the screen support frame structure 102, the automatic horizontal driving of the frame structure 102 is greatly simplified compared to the screen frame drive systems employed in conventional tilt screen type screen printing machines. Simply stated, due to the unique construction of the rocker housing structure 38, no portion of the illustrated horizontal drive means 200 needs to rotate with the pivoting screen support frame structure 102-the horizontal driving of such structure may be effected by a simple and relatively inexpensive drive structure, such as the rodless cylinder assembly 200, secured directly to the support frame portion 14 of the screen printing machine 12.

For purposes of illustration, the upper rocker housing structure 36 has been shown in a manually translatable configuration-i.e., it is not provided with an automatic drive means corresponding to the previously described air drive cylinder 200. However, the end plate portion 42 of the nonrotatable section 40 of the upper rocker housing structure 36 is provided with an upwardly projecting connection tab 214 to which the outer drive portion of a second air drive cylinder could be operatively connected, with the opposite ends of the elongated inner portion of the additional air drive cylinder being positionable and retainable with upper end slots 216 formed in the support plate members 20 and 22.

One of the problems heretofore associated with conventional tilt screen type screen printing machines is the maintenance, during imprintation of round objects such as cups, of a predetermined correlation or registry between the rotation of the article being imprinted and the translational movement of the printing screen from one imprinting cycle to the next. Due to the previous complexity of providing this necessary screen translation-/article rotation correlation, conventional tilt screen type screen printing machines have typically not been utilized in the imprintation of round articles. In the present invention, however, this previous registration problem has been uniquely solved in a manner which will now be described with primary reference to FIG. 5 which illustrates the screen printing machine 12 being used to imprint a cup 218 having a handle 220.

To rotatably support the cup 218, a generally conventional rotational cup jig assembly 222 is used. The assembly 222 includes a mounting bracket 224 secured to the horizontal lift table arm 150 by a bolt 226. A conventional air driven piston and cylinder structure 228 is supported on an upper end of the bracket 224 and is operatively connected to air lines 230 and 232. The left end of the drive structure 228 is coaxially secured to a hollow cylindrical cup retaining member 234, the drive structure 228 being operable by the air lines 230, 232 to selectively drive the cup retaining member 234 rightwardly or leftwardly as viewed in FIG. 5.

The cup jig assembly 222 also includes a mounting bracket 236 positioned to the left of the bracket 224 and anchored to the horizontal lift table arm 150 by a bolt 238. A drive shaft 240 is rotatably supported within an opening in the upper end of bracket 236, and is coaxially anchored at its right end to a cylindrical cup retaining member 242, and at its left end to a pinion gear 244. The peripheral teeth 246 are operatively engaged by the bottom side teeth 248 of an elongated, horizontally disposed gear rack member 250. As best illustrated in FIGS. 1, 2A and 2B, the gear rack 250 is secured by bolts 252 to a horizontally extending support bar 254 suitably anchored to the nonrotatable portion 56 of the lower rocker housing structure 38 and positioned forwardly of the rotatable rocker housing portion 70.

At the start of the printing cycle for the cup 218, the printing screen support frame structure 102 is at its rightmost horizontal limit position, with a printing screen 256 operatively secured to the screen support members 136 by the clamping structures 138. With the screen support structure 102 and the screen's pivot lever 106 pivoted to their upper limit positions, the cup 218 is loaded into the cup jig assembly 222 by rightwardly retracting the cup retaining member 234, positioning the open end of the cup 218 over the right end of the cup retaining member 242, rotating the cup to bring its handle 220 upwardly into engagement with a handle registry bar 258 secured to the cup retaining member 242, and the cup retaining member 234 is leftwardly extended over the closed end of the cup to firmly hold the cup in its position indicated in FIG. 5.

The screen 256 is then downwardly pivoted to its generally horizontal operating position above the retained cup 218, and the squeegee member 126 is brought downwardly into engagement with the upper side of the horizontal screen 56, the lever 106 and the squeegee 126 being prevented from moving horizontally by appropriate adjustment of the stop collar members 96 (FIG. 1).

Figure 5:
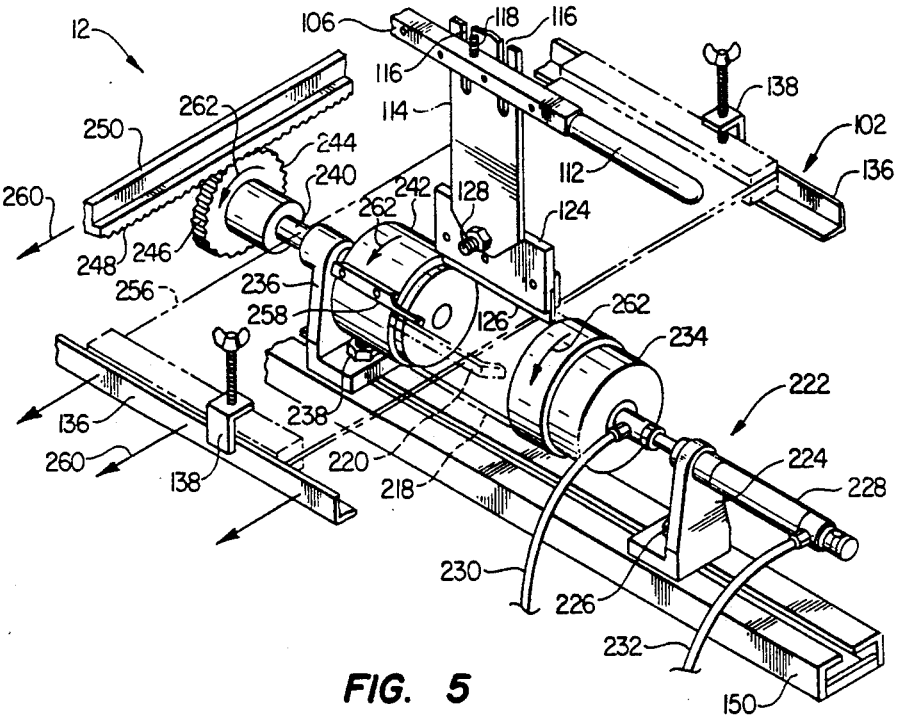
FIG. 5 is a fragmentary perspective view of the machine being used to transfer a design from a supported printing screen to the exterior side surface of a rotationally supported cup shown in phantom.

Next, the air drive cylinder 200 in operated to move the lower rocker housing assembly 38, and thus the screen support structure 102 and the gear rack 250, in a leftward direction as indicated by the arrows 260 in FIG. 5. Leftward movement of the gear rack 250 rotationally drives the pinion gear 246, and thus the handle registry bar 258, in a counterclockwise direction as indicated by the arrows 262. The interengagement between the handle registry bar 258 and the cup handle 220 correspondingly rotates the cup 218 in a counterclockwise direction as indicated by the arrow 262. Leftward horizontal movement of the screen 256 between the stationary squeegee member 126 and the rotating cup 218 drives printing ink previously deposited on the upper side of the screen downwardly therethrough to transfer the screen indicia to the outer side of the cup.

After the screen 256 has been moved to its leftward limit position, and the cup 218 has been simultaneously rotated through its entire imprintation stroke, the lever 106 and screen support structure 102 are pivoted upwardly away from the finished cup, and the cup 218 is removed by rightwardly retracting the cup retaining member 234 and removing the cup from the cup retaining member 242. The upwardly pivoted screen support structure 102 is then rightwardly moved to its rightward stop position, such rightward movement of the screen support structure, via the rightward movement of the gear rack 250, automatically rotating the cup retaining member 242 back to its rotational starting position depicted in FIG. 5. The next cup is then operatively positioned on the cup jig assembly 222, the screen and the squeegee member are lowered, and the previously described cup imprintation process is repeated for the second cup.

Quite importantly, the upward pivoting of the screen support structure 102 after each successive cup is imprinted, does not disengage the rack gear teeth 248 from the pinion gear teeth 246. This is due to the fact that the gear rack 250 is fixedly secured to the nonrotatable portion 56 of the lower rocker housing structure 38 and is thus not rotated as the screen support structure 102 is upwardly pivoted. Accordingly, due to the unique construction and operation of the lower rocker housing structure 38, the predetermined correlation between the translational movement of the screen support structure 102 with the simultaneous rotational movement of the supported cup, is automatically and precisely maintained throughout each successive cup imprintation cycle. This feature of the present invention easily and inexpensively permits a tilt screen type screen printing machine to accurately imprint a variety of round articles.

Figure 6A:
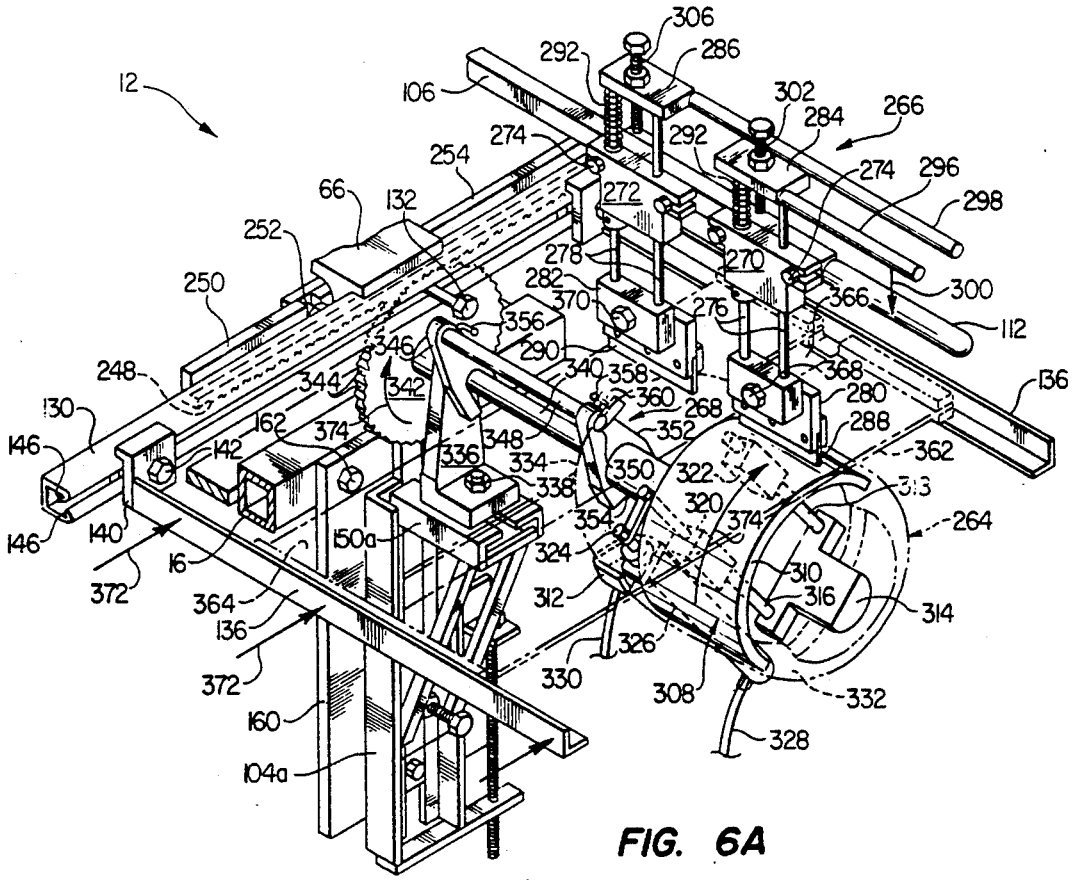
FIGS. 6A and 6B are fragmentary perspective views of the machine being used in a two-color hat printing process in which specially designed dual squeegee and telescoping hat support structures of the present invention are employed.
Figure 6B:
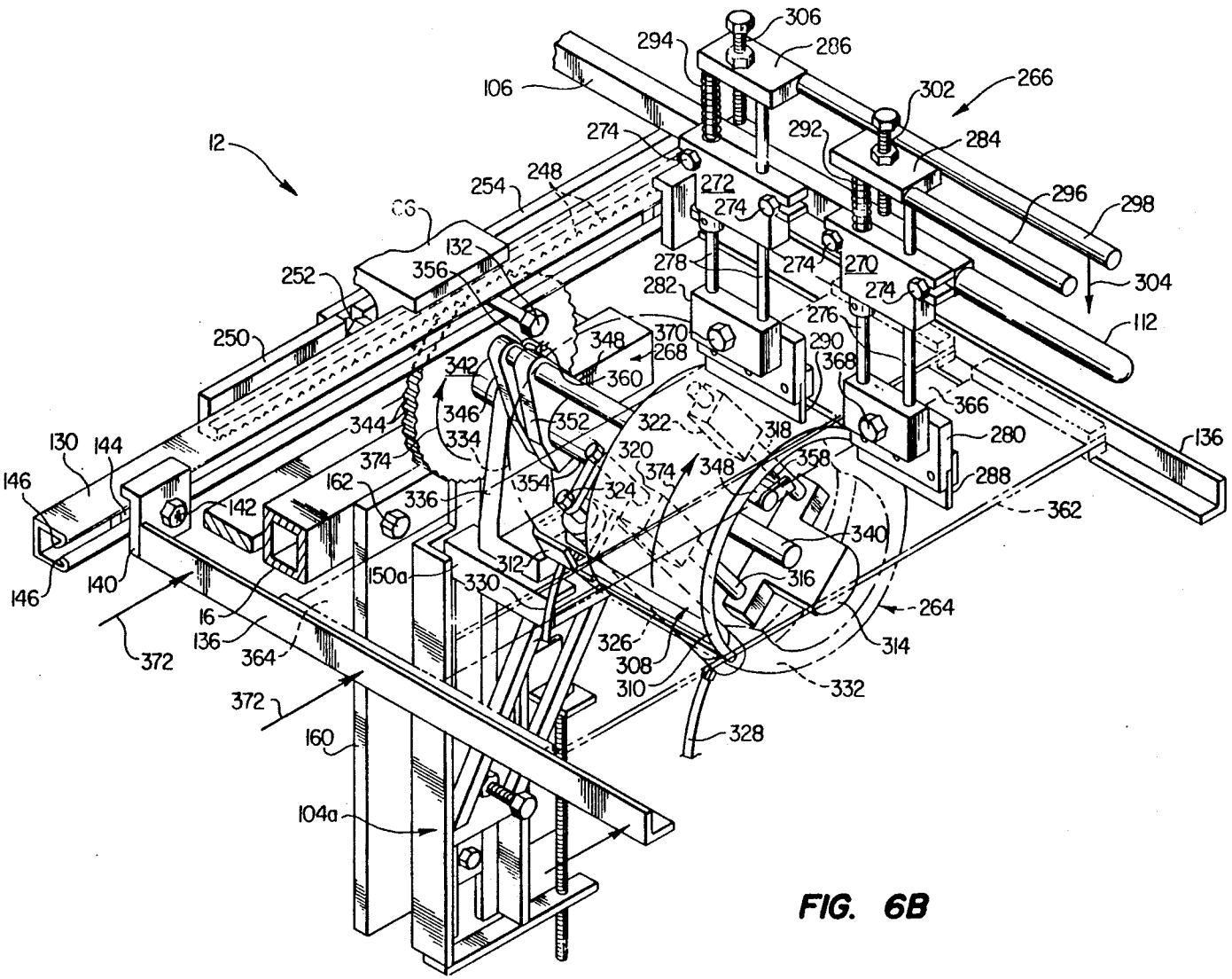

In accordance with another feature of the present invention, specially designed attachments are secured to the screen printing machine 12 to permit it to perform, in a simple and rapid manner, a two-color imprintation process on a round object such as the hat 264 shown in phantom in FIGS. 6A and 6B. As illustrated in FIGS. 6A and 6B, these attachments include a modified lift table assembly **104*a*, a dual squeegee assembly 266, and a telescopable, two-position hat jig structure 268**.

The modified lift table assembly **104*a* is identical in construction and operation to the previously described lift table assembly 104, with the exception that its horizontal arm portion 150*a* is considerably shorter. The dual squeegee assembly 266 includes a pair of mounting blocks 270 and 272 removably secured to the squeegee pivot lever 106 by bolts 274, the mounting block 270 being positioned adjacent the lever handle 112, and the mounting block 272 being positioned inwardly of the block 270 along the length of the lever 106. Slidably received in the blocks 270 and 272, respectively, are pairs of vertical rods 276 and 278 which are secured at their bottom ends to squeegee holding structures 280 and 282, and at their to ends to drive plates 284 and 286**.

The squeegee holding structures 280, 282 respectively support downwardly projecting squeegee members 288, 290 which are resiliently biased in an upward direction by a coil spring 292 which encircles one of the rods 276 and bears at its opposite ends against the block 270 and the plate 284, and a coil spring 294 which encircles one of the rods 278 and bears at its opposite ends against the block 272 and the plate 286. Respectively secured to the drive plates 284 and 286, and projecting forwardly therefrom, are a pair of squeeze rods 296 and 298 whose outer or right ends are positioned over the lever handle 112.

The forward squeegee 288 may be selectively lowered from its upwardly biased position simply by grasping the lever handle 112 and the rod 296 and squeezing these two elements together, thereby driving the rod 296 downwardly toward the handle 112 as indicated by the arrow 300 if FIG. 6A. Release of the rod 296 permits the spring 292 to return the squeegee 288 to its normal, upwardly retracted position. The degree of downward travel of the squeegee 288 may be selectively limited by means of an adjustment bolt 302 threaded into the drive plate 284 and having a lower end which is brought to bear against the top side of the block 270 when the rod 296 is squeezed toward the lever handle 112.

In a similar fashion, the squeegee 290 may be lowered from its normal, upwardly retracted position simply by grasping the lever handle 112 and the rod 298 and squeezing these two elements together to move the rod 298 toward the lever handle 112, as indicated by the arrow 304 in FIG. 6B, the available downward movement of the squeegee 290 being selectively variable by an adjustment bolt 306 threaded into and projecting downwardly from the drive plate 286.

With continued reference to FIGS. 6A and 6B, the hat jig structure 268 includes a generally conventional rotatable head portion 308 which, in a unique manner subsequently described herein, is horizontally movable between a rightwardly extended position (FIG. 6A) and a leftwardly retracted position (FIG. 6B). The head portion 308 includes an arcuate support plate 310 from which a bill alignment tab 312 leftwardly projects. A generally T-shaped pressure member 314 is anchored as shown to first ends of rods 316, 318 which are slidably received in guide blocks 320, 322 carried by the arcuate plate 310. The upper end of rod 316 is operatively secured to the rod portion 324 of an air drive cylinder 326 to which air lines 328, 330 are connected. Air drive cylinder 326 is carried by the arcuate plate 310 and, in a conventional manner, is selectively operable to extend the pressure member 314 diametrically away from the arcuate plate 310, or to diametrically retract the pressure member 314 toward the arcuate plate.

The illustrated hat 264 has a crown 332 and a bill 334, and is operatively positioned on the head portion 308 by retracting the pressure member 314, placing the crown 332 over the arcuate plate 310 and engaging the bill 334 with the alignment tab 312, and then outwardly extending the pressure member 314 to firmly hold the hat 264 on the head portion 308.

The hat jig fixture 268 also includes a mounting bracket 336 having a base portion secured to the horizontal lift table arm 150*a* by a bolt 338. The inner or left end of a drive shaft 340 is rotatably received, and axially fixed, within a suitable opening in the upper end of bracket 336, and is coaxially anchored to a pinion gear 342 having peripheral teeth 344 that operatively mesh with the teeth 248 of the previously described gear rack member 250. Fixedly secured to the shaft 340, immediately to the right of the top end of bracket 336, is a radially outwardly projecting bracket 346 which is anchored at its outer end to the inner end of a power transfer rod 348. Rod 348 is slidably received in an outer end opening 350 of a bracket 352 anchored at its inner end to a hollow tube 354 secured to and projecting axially leftwardly from the arcuate plate 310. Drive shaft 340 is telescoped within the hollow tube 354.

As may be seen by comparing FIGS. 6A and 6B, the hat jig structure head portion 308 may be moved between its outwardly extended position (FIG. 6A) and its inwardly retracted position (FIG. 6B) simply by pushing the head portion 308 toward the pinion gear 342 or pulling the head portion 308 outwardly away from the pinion gear. When the head portion 308 is moved to its FIG. 6B retracted position, the drive shaft 340 and the rod 348 are respectively moved rightwardly through the hollow tube 354 and the opening 350 in bracket 352. The head portion 308 is releasably retained in either its rightwardly extended or leftwardly retracted position by means of a detent member 356 secured to bracket 346, a detent member 358 secured to the right hand of rod 348, and a clip member 360 secured to the bracket 352. When the head portion 308 is moved to its rightwardly extended position (FIG. 6A), the clip member 360 snaps onto and releasably holds the detent member 358, and when the head portion 308 is moved leftwardly to its fully retracted position (FIG. 6B), the clip member 360 snaps onto and releasably holds the detent member 356.

Prior to performing the two-color printing process which will now be described, a pair of relatively narrow printing screens 362 and 364 are operatively secured to the screen support members 136 by means of the previously described screen clamps 138 which have been omitted from (FIGS. 6A and 6B) for purposes of illustrative clarity. As illustrated, the operatively mounted screens 362, 364 are horizontally spaced apart from one another, leaving a gap 366 therebetween. Printing ink of the first color is suitably applied to the upper side surface of the front screen 362, and printing ink of a second color is applied to the upper side surface of the rear screen 264.

Referring initially to FIG. 6A, the two-color hat printing process is carried out as follows. The pivot lever 106 is locked against horizontal movement using the stop collars 96 (FIG. 1) and, with the lever 106 and the screen support structure upwardly pivoted, the screen support structure is moved to its predetermined left limit position. Due to the interaction between the gear rack member 250 and the pinion gear 342, this rotationally indexes the outwardly extended head portion 308 to its starting position depicted in FIG. 6A. With the hat 264 operatively secured to the head portion 308, the screen support structure is lowered to its horizontal operating position, and the pivot lever 106 is also lowered. With the pivot lever 106 lowered in this manner, the front and rear squeegee members 288, 290 are each positioned slightly above the underlying screens 362 and 364. The initial clearance between the squeegee members 288, 290 and their underlying screens 362, 364 is preset by loosening bolts 368 and 370 on the squeegee holding structures 280 and 282, sliding the structures 280, 282 upwardly or downwardly along their associated vertical rods 276 and 278, and then retightening the bolts 368, 370 to hold the squeegee holding structures 280, 282 in their vertically adjusted positions. As illustrated in FIG. 6A, with the screens 362, 364 in their lowered positions, the hat bill 334 projects upwardly through the screen gap 366.

Next, the machine operator grasps the rod 296 and the lever handle 112 and squeezes them together to lower the squeegee member 288 onto the upper side of the screen 362. The screen support structure is then rightwardly moved, as indicated by the arrows 372, to create a simultaneous clockwise rotation of the pinion gear 342 and the hat jig head portion 308 as indicated by the arrows 374. Such rightward movement of the screen support structure, and the counterclockwise rotation of the hat 264, imprints the indicia from screen 362 on the hat crown 332 in the selected first color. The operator then releases the rod 296 which automatically lifts the front squeegee member 288 upwardly apart from the screen 362. The operator then upwardly pivots the lever 106 and the screens 362 and 364.

Referring now to FIG. 6B, the operator then pushes the hat jig head portion 308 inwardly to its releasably locked retracted position, and moves the upwardly pivoted screen support structure horizontally back to its left limit position, thereby returning the hat 264 to its original rotational starting position. The screen support structure is then pivoted downwardly to place the rear screen 364 directly above the hat crown 332, the upwardly projecting hat bill 334 being disposed rearwardly of the rear screen 364 The pivot lever 106 is again lowered, and the operator grasps and squeezes the rod 298 and the handle 112 to lower the rear squeegee element 290 onto the upper surface of the rear screen 364.

The lowered screen support structure is then horizontally moved to its right limit position, as indicated by the arrows 372, to again rotate the hat 264 in a clockwise direction as indicated by the arrow 374. Such simultaneous rightward movement of the screen 364 and clockwise rotation of the supported hat causes the imprintation of the indicia on screen 364 in the predetermined second color.

When the screen support structure reaches the rightward limit of its horizontal stroke, the operator releases the rod 298 which causes the upward retraction of the rear squeegee member 290 from the screen 364. The lever 106, and the screen support structure, are then upwardly pivoted and the pressure member 314 is retracted. The decorated hat 264 is then removed from the head portion 308, the next hat is operatively secured on the head portion 308, and the two-color printing process just described is repeated for each successive hat. For each successive hat, this two-color printing process is very easily and rapidly carried out using a single set-up process, and without the necessity of replacing, interchanging or repositioning the screens.

Figure 7:
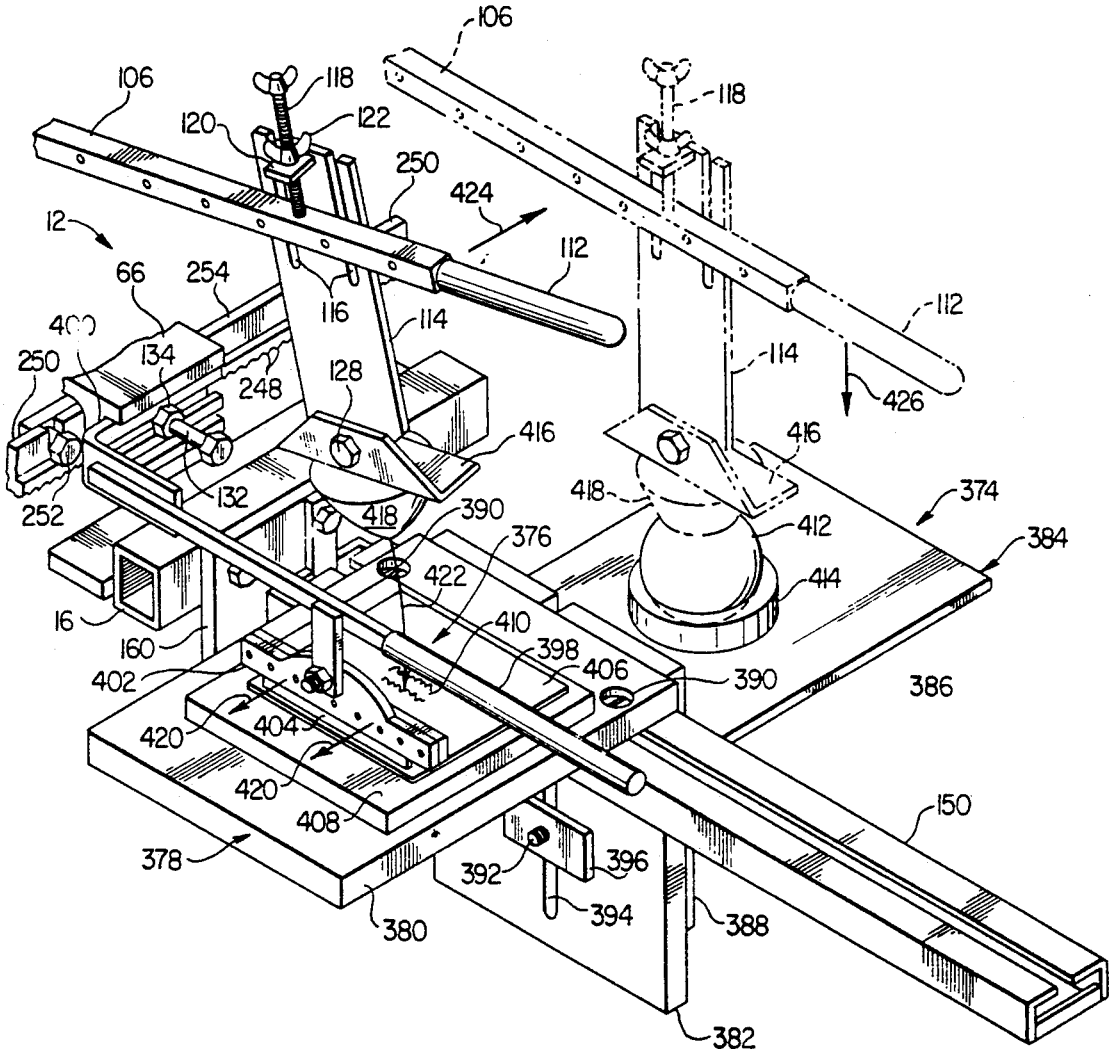
FIG. 7 is a fragmentary perspective view of the machine being used, with specially designed attachments, to carry out a pad printing process.

In addition to the various previously described screen printing functions the machine 12 is capable of performing, by virtue of specially designed attachments shown in FIG. 7 the machine is also capable of performing a pad printing process which will now be described. Such attachments include an auxiliary lift table assembly 374 and a cliche scraper structure 376. The auxiliary lift table assembly 374 includes a first table portion 378 having horizontally and vertically extending top and side sections 380 and 382, and a second table portion 384 having horizontally and vertically extending top and side section 386 and 388. The first table portion section 380 is removably and adjustably secured to the upper side of the main lift table arm portion 150 by means of screws 390 and projects leftwardly from the arm portion 150. The second table portion section 388 abuts and is secured to the section 382 by means of a retention screw 392 which extends through a vertical slot 394 in section 382 and is threaded into a friction plate 396. This interconnection between the table portions 378 and 384 permits the height of the table portion 384 to be selectively adjusted simply by loosening the screw 392, vertically adjusting the table portion 384 relative to the table portion 378, and then retightening the screw 392.

The scraper structure 376 includes a lever 398 having an angled rear end portion 400 which, after the previously described printing screen support frame structure 102 has been removed from the machine 12, is positioned within the front end of the bracket member 66 and anchored therein by the bolt 132. A generally T-shaped support structure 402 depends from a longitudinally intermediate portion of the lever 398 and has a cliche scraper blade 404 secured to and depending from its lower side edge. Because of its connection to the bracket member 66, the lever 398 may be pivoted upwardly and downwardly relative to the auxiliary lift table assembly 384, and may also be moved horizontally relative thereto through a horizontal stroke determined by the positioning of the locking collars 98 (FIG. 1).

To ready the machine 12 for the pad printing operation, a conventional cliche plate 406 is suitably secured to a base plate 408 positioned atop the auxiliary table section 380. Cliche plate 406 has engraved or otherwise suitably recessed in its topside surface indicia 410 which is to be transferred to an object such as a golf ball 412 received in a suitable holder 414 supported on the auxiliary lift table section 386 as illustrated. In setting up the machine 12 for the pad printing process, the previously described transverse plate 124 (FIG. 1) is removed from the lower end of the squeegee support plate 114 and is replaced with an angled support bracket 416 having a resilient, somewhat conically shaped pad printing transfer member 418 (of conventional design and construction) suitably secured to its bottom side surface.

To initiate the pad printing process, a quantity of ink (not shown) is deposited on the top side of cliche plate 406 to the left of the recessed indicia 410. With the scraper blade 404 contacting the upper cliche plate side surface, the lever 398 is moved rightwardly across the indicia 410 to deposit a quantity of the ink therein. The scraper blade 404 is then moved leftwardly across the indicia 410, as indicated by the arrows 420, to scrape away the excess ink from the top side of the cliche plate, leaving the ink only within the recessed indicia. The lever 106 is then downwardly pivoted, as indicated by the arrow 422, to compress the pad printing transfer member 418 against the upper side of the cliche plate 406, over the inked indicia 410, to transfer an ink pattern (corresponding to the pattern of the indicia 410) to the underside of the member 418.

The lever 106 is then pivoted upwardly, and rightwardly translated, as indicated by the arrow 424, to position the inked transfer member 418 over the golf ball 412. The lever 106 is then downwardly pivoted to its phantomed position shown in FIG. 7, as indicated by the arrow 426, to compress the pad printing transfer member 418 against the upper side of the golf ball 412 to transfer the ink pattern on the compressed member 418 to the golf ball. Finally, the lever 106 is again pivoted upwardly, to separate the member 418 from the golf ball, and the now imprinted golf ball is removed and a new golf ball is set in place on the holder 414. The process is then repeated for each successive golf ball.

It can be seen that the incorporation into the screen printing machine 12 of the pad printing apparatus just described significantly expands it overall object decorating capability. As just described, the pad printing process, for the representative golf ball 412 or a variety of other objects, may be very quickly and quite easily carried out. It may also be quite accurately performed due to the ability to precisely adjust the horizontal strokes of the levers 106 and 398 by suitably adjusting the locking collar 96 and 98 illustrated in FIG. 1.

Figure 8:
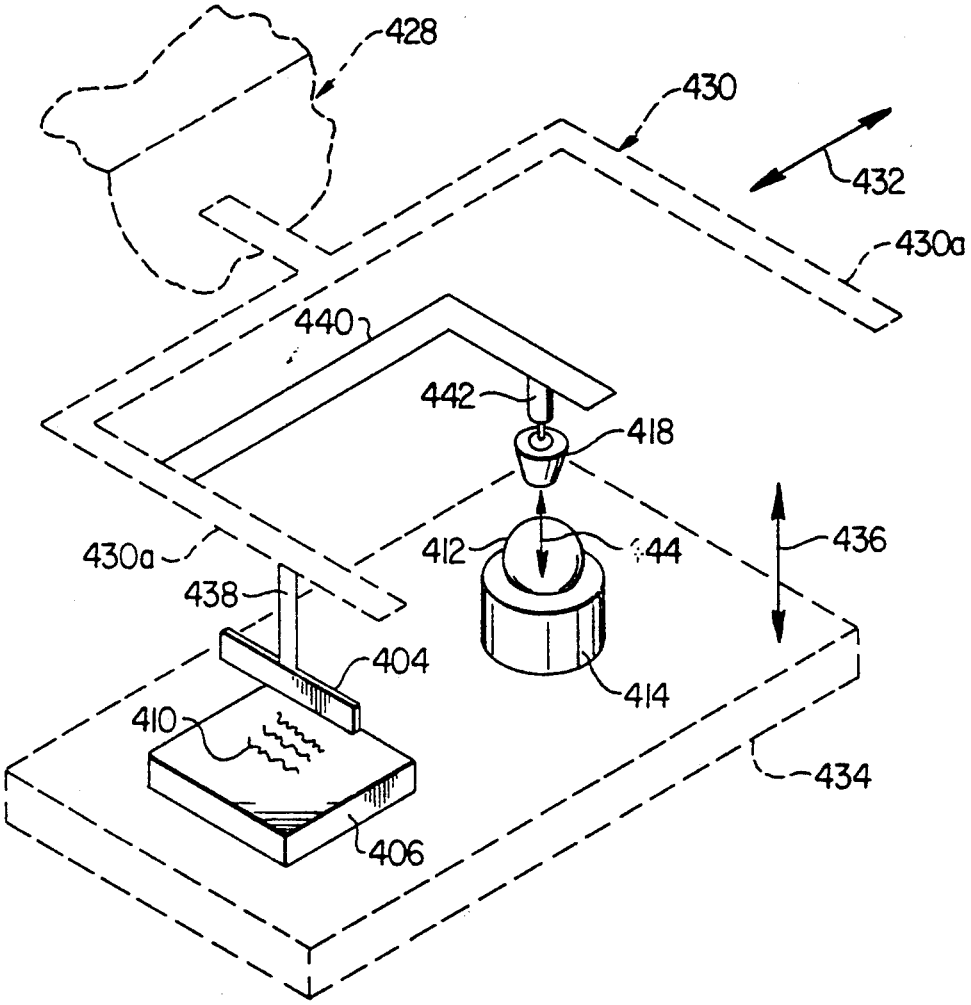
FIG. 8 is a partially phantomed schematic perspective view of a portion of a conventional, non-tilt screen type screen printing machine which, according to a feature of the present invention, has been modified for use in a pad printing process.

According to another feature of the present invention, a conventional, non-tilt screen type screen printing machine 428 (FIG. 8) may be quickly and easily converted for use in a pad transfer printing process. The conventional screen printing machine 428 has a non-pivotable printing screen support frame structure 430 which is horizontally translatable in a left-to-right direction as indicated by the double-ended arrow 432 in FIG. 8. The support frame structure 430 is upwardly spaced apart from a suitable article support base 434 which is selectively movable in upward and downward directions relative to the support frame structure 430 as indicated by the double-ended arrow 436.

To convert the conventional screen printing machine 428 to a pad transfer printer, a cliche scraper blade 404 is operatively mounted on the lower end of a depending support member 438 removably secured to one of the forwardly projecting side portions **430*a* of the support frame structure 430. Additionally, a horizontal support member 440 is suitably secured to the frame structure 430 and operatively supports a flexible pad printing member 418 in a depending relationship therewith by means of a pneumatic cylinder structure 442 selectively operable to upwardly and downwardly move the pad printing member 418 as indicated by the double-ended arrow 444**.

To use the conventional screen printing machine 428 as a pad transfer printer (with the pad printing attachments secured thereto as just described), a cliche plate 406 and the previously described golf ball holder 414 are operatively positioned atop the support base 434, and a golf ball 412 is placed on the holder 414. As previously mentioned, the golf ball 412 is merely representative of an article to be pad printed, other articles could, of course, be operatively supported on the support base 434.

By raising the support base 434 from its indicated position, the scraper blade 404 may be brought into engagement with the cliche plate 406, and the screen support frame structure 430 translated leftwardly and rightwardly to ink the cliche plate indicia 410 as previously described. The support base 434 is then slightly lowered, and the screen support structure 430 is then leftwardly translated to position the pad printing member 418 over the cliche plate indicia 410. The pad printing member 418 is then pneumatically driven downwardly to compress it against the inked indicia 410 and is then raised. The screen support structure 430 is then rightwardly translated to position the now inked pad printing member 418 directly over the golf ball 412. Finally, the inked pad printing member 418 is driven downwardly into engagement with the golf ball 412 to imprint it, and is then raised. It can readily been that by removably securing the simple and inexpensive pad printing attachments to the screen support structure 430 of the conventional screen printing machine 428, the machine may be rapidly converted to a pad transfer printer utilizing the normal movements of the screen printing machine components.

It will be appreciated that the various embodiments of the present invention described above may be modified in various manners without departing from the spirit and scope of the present invention. For example, all of the manual movements of the various components could, of course, be automatically effected using, for example, pneumatic drive means. Additionally, the unique rocker housing structure used on the improved tilt screen type screen printing machine could be provided with a variety of alternate constructions and configurations while still providing their underlying operational advantages. Moreover, various of the attachments described above could alternatively be employed in conjunction with other types of screen printing machines. From the foregoing it can readily be seen that the present invention provides a compact, multi-function decorating machine which is easy to use, may be manufactured from simple, relatively inexpensive components, and is quickly convertible between its various object-decorating modes.

The foregoing detailed description is to be clearly understood as being given by way of illustration and example only, the spirit and scope of the present invention being limited solely by the appended claims.

What is claimed is:

1. Screen printing apparatus comprising:

first and second elongated members;

support means for supporting said first and second elongated members in a generally horizontal, laterally spaced apart position;

a squeegee support structure;

a printing frame support structure;

first attachment means for operatively attaching said squeegee support structure to said first elongated member for horizontal movement relative thereto parallel to the length of said first elongated member, and vertical pivotal motion relative to said first elongated member about an axis parallel to its length; and second attachment means for operatively attaching said printing screen support structure to said second elongated member for horizontal movement relative thereto parallel to the length of said second elongated member, and vertical pivotal motion relative to said second elongated member about an axis parallel to its length, at least one of said first and second attachment means including:

a first carrying structure mounted on one of said first and second elongated members for translation along its length, means for preventing appreciable rotation of said first carrying structure laterally about said one of said first and second elongated members, a second carrying structure mounted on said first carrying structure for translation therewith and for rotation relative thereto about an axis parallel to the length of said one of said first and second elongated members, and means for anchoring one of said squeegee support structure and said printing screen support structure to said second carrying structure for translation and rotation therewith relative to said one of said first and second elongated members.

2. The screen printing apparatus of claim 1 wherein said at least one of said first and second attachment means comprises said second attachment means, and wherein said printing apparatus further comprises:

article holding means for supporting an article to be imprinted for operative rotation about a generally horizontal axis positioned lower than said first and second elongated members and extending generally transversely to their lengths, and cooperating means, carried by said article holding means and said first carrying structure, for operatively rotating an article, supported by said article holding means, about said generally horizontal axis in response to translation cf said first carrying structure parallel to the length of said second elongated member.

3. The screen printing apparatus of claim 2 wherein:

said cooperating means comprise cooperating gear means.

4. The screen printing apparatus of claim 3 wherein said cooperating gear means include:

a pinion gear carried by said article holding means and drivable to operatively rotate an article held thereby, and an elongated horizontal gear rack carried by said first carrying structure for translation therewith and drivingly intermeshed with said pinion gear.

5. The screen printing apparatus of claim 1 wherein:

said at least one of said first and second attachment means comprises both of said first and second attachment means.

6. The screen printing apparatus of claim 1 further comprising:

drive means for translationally driving said first carrying structure along the length of its associated one of said first and second elongated members.

7. The screen printing apparatus of claim 6 wherein:

said drive means include a rodless air cylinder having an elongated inner portion horizontally secured to said support means, and an outer drive portion movable along the length of said inner portion and anchored to said first carrying structure.

8. The screen printing apparatus of claim 1 wherein said means for preventing appreciably rotation of said first carrying structure include:

a rod member horizontally carried by said support means, and first and second roller members mounted on said first carrying structure and positioned on horizontally opposite sides of said rod member.

9. Printing apparatus comprising:
an elongated member;
support means for supporting said elongated member in a generally horizontal orientation;
a printing structure; and
attachment means for connecting said printing structure to said elongated member for translation relative thereto along its length, and for vertical pivotal motion relative thereto about an axis parallel to its length, said attachment means including:
a first carrying structure mounted on said elongated member for translation along its length,
means for preventing appreciable rotation of said first carrying structure laterally about said elongated member,
a second carrying structure mounted on said first carrying structure for translation therewith and for rotation relative thereto about said axis, and
means for anchoring said printing structure to said second carrying structure.

10. The printing apparatus of claim 9 wherein:
said printing apparatus is a tilt screen type screen printing machine, and
said printing structure is a squeegee support structure.

11. The printing apparatus of claim 9 wherein:
said printing apparatus is a tilt screen type screen printing machine, and
said printing structure is a printing screen support frame structure.

12. The printing apparatus of claim 9 further comprising:
an elongated gear rack member longitudinally extending parallel to said elongated member and anchored to said first carrying structure for translation therewith along the length of said elongated member.

13. The printing apparatus of claim 9 further comprising:
drive means carried by said support means and selectively operative to drivingly translate said attachment means along the length of said elongated member.

14. The printing apparatus of claim 13 wherein said drive means include:
a rodless air drive cylinder having an elongated inner portion anchored at opposite ends to said support means, an outer drive portion outwardly circumscribing said elongated inner portion and driveable along its length, and means for securing said outer drive portion to said first carrying structure.

15. Printing apparatus comprising:
an elongated member;
support means for supporting said elongated member in a generally horizontal orientation;
a printing structure; and
attachment means for connecting said printing structure to said elongated member for translation relative thereto along its length, and for vertical pivotal motion relative thereto about an axis parallel to its length, said attachment means including:
a tubular member coaxially and outwardly circumscribing said elongated member,
slide bearing means, disposed within said tubular member and engaging said elongated member, for facilitating sliding translational movement of said tubular member along the length of said elongated member,
means for preventing appreciable rotation of said tubular member about said elongated member,
a carrying structure mounted on said tubular member for translation therewith along the length of said elongated member, and for rotation relative to said tubular member about its axis, said carrying structure having an opening therethrough which outwardly circumscribes said tubular member,
rotational bearing means, disposed within said opening and outwardly engaging said tubular member, for facilitating said rotation of said carrying structure relative to said tubular member, and
means for anchoring said printing structure to said carrying structure for translational and rotational motion therewith.

16. The printing apparatus of claim 15 wherein:
said printing apparatus is a tilt screen type screen printing machine, and
said printing structure is a squeegee support structure.

17. The printing apparatus of claim 15 wherein:
said printing apparatus is a tilt screen type screen printing machine, and
said printing structure is a printing screen support frame structure.

18. The printing apparatus of claim 15 wherein said means for preventing appreciable rotation include:
a rod member horizontally carried by said support means, and
connecting means interconnected between said tubular member and said rod member and preventing appreciable rotation of said tubular member about said elongated member.

19. The printing apparatus of claim 18 wherein:
said connecting means include a connecting member anchored to said tubular member, said connecting member having first and second roller members secured thereto for rolling engagement with horizontally opposite sides of said rod member.

20. The printing apparatus of claim 15 further comprising:
an elongated gear rack member, and
means for securing said gear rack member to said attachment means for translation therewith, said gear rack means longitudinally extending generally parallel to said elongated member,
and wherein said means for preventing appreciable rotation are operative to prevent appreciable rotation of said gear rack member about said elongated member.

21. Pad transfer printing apparatus comprising:
a screen printing machine convertible between screen printing and pad transfer printing uses and including:
first and second elongated members;
first support means for supporting said first and second elongated members in a generally horizontal, laterally spaced apart position,
a first carrying structure mounted on said first elongated member for translation along its length, at least a portion of said first carrying structure being rotatable about said first elongated member and being connectable to a squeegee support structure used for screen printing purposes, and
a second carrying structure mounted on said second elongated member for translation along its length, at least a portion of said second carrying structure being rotatable about said second elongated member and being connectable to a printing screen support frame structure used for screen printing purposes;

second support means for horizontally supporting a cliche plate having recessed indicia on an upper side surface thereof, and for supporting an article to be pad printed in a location spaced apart from the cliche plate in a direction parallel to the lengths of said first and second elongated members;

a first lever member having a flexible pad printing member operatively secured thereto;

first means for securing said first lever member to said portion of said first carrying structure in a manner permitting said first lever member to be sequentially:

translated to a first raised position, downwardly pivoted from said first raised position to compress said pad printing member against the upper side of the cliche plate to transfer ink from within the recessed indicia thereon to the underside of the pad printing member, upwardly pivoted and translated to a second raised position, and downwardly pivoted from said second raised position to compress said pad printing member against the object to imprint the same;

a second lever member having a cliche scraper blade operatively secured thereto; and second means for securing said second lever member to said portion of said second carrying structure in a manner permitting said second lever member to be sequentially:

downwardly pivoted from a raised position to bring said scraper blade into contact with the upper side surface of the cliche plate, and translated in opposite direction to deposit ink previously placed on the upper cliche plate side surface into the recessed indicia and then scrape away ink from the upper cliche plate side surface.

22. The pad transfer printing apparatus of claim 21 wherein:

each of said first and second carrying structures has a first section translatable along the elongated member on which the carrying structure is mounted, and a second section carried by the first section for translation therewith and rotation relative thereto about an axis parallel to the length of the elongated member on which the carrying structure is mounted, said first means for securing are operative to anchor said first lever member to said second section of said first carrying structure, said second means for securing are operative to anchor said second lever member to said second section of said second carrying structure, and said screen printing machine further includes means for preventing appreciable rotation of either of said first sections about the elongated member on which it is mounted.

23. Pad transfer printing apparatus comprising:

a screen printing machine having:

a base portion selectively movable in upward and downward directions, and a printing screen support frame structure disposed above said base portion and being horizontally translatable relative thereto in a translation direction;

means for supporting on said base portion an article to be imprinted, and a cliche plate having recessed indicia thereon and being spaced apart from the supported article in a direction generally parallel to said translation direction;

a flexible pad printing member;

a cliche scraper blade; and means for removably securing the pad printing member and the scraper blade to said printing screen support frame structure, and for selectively creating vertical movement of the pad printing member relative to said printing screen support frame structure, in a manner permitting ink to be deposited into said recessed cliche plate indicia by said scraper blade, the deposited ink to be transferred to the underside of said pad printing member, and the transferred ink to be deposited upon the supported article to imprint the same, by respectively utilizing the normal vertical and horizontal movements of said base portion and said printing screen support frame structure, and by vertically moving said pad printing member relative to said printing screen support frame structure.

* * * * *